US010867725B1

(12) United States Patent
Huang et al.

(10) Patent No.: US 10,867,725 B1
(45) Date of Patent: Dec. 15, 2020

(54) HIGH FREQUENCY SIGNAL TRANSMISSION CABLE

(71) Applicant: Hitachi Metals, Ltd., Tokyo (JP)

(72) Inventors: Detian Huang, Tokyo (JP); Yoshinori Tsukamoto, Tokyo (JP); Masashi Moriyama, Tokyo (JP); Hideyuki Sagawa, Tokyo (JP); Takahiro Sugiyama, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/596,529

(22) Filed: Oct. 8, 2019

(30) Foreign Application Priority Data

Jul. 1, 2019 (JP) ..... 2019-123167

(51) Int. Cl.

| | |
|---|---|
| ***H01B 7/02*** | (2006.01) |
| ***H01B 11/06*** | (2006.01) |
| ***H01B 1/02*** | (2006.01) |
| ***H01B 13/22*** | (2006.01) |
| ***H01B 7/30*** | (2006.01) |
| ***H01B 11/18*** | (2006.01) |

(52) U.S. Cl.
CPC ..... *H01B 11/06* (2013.01); *H01B 1/026* (2013.01); *H01B 7/303* (2013.01); *H01B 11/1808* (2013.01); *H01B 13/22* (2013.01)

(58) Field of Classification Search
CPC ..... H01B 7/0208
See application file for complete search history.

(56) References Cited

U.S. PATENT DOCUMENTS

| | | | | |
|---|---|---|---|---|
| 3,362,861 | A * | 1/1968 | Barker | H01B 3/008 156/53 |
| 6,953,888 | B2 * | 10/2005 | Livshitz | H01B 11/1834 174/106 R |
| 8,822,824 | B2 * | 9/2014 | Kelley | H01B 7/04 174/110 R |
| 10,269,470 | B2 * | 4/2019 | Nakajima | B29C 48/05 |
| 10,332,654 | B2 * | 6/2019 | Lawrence | H02G 1/1202 |
| 2013/0213687 | A1 * | 8/2013 | Johnsen | H01B 7/188 174/113 R |

FOREIGN PATENT DOCUMENTS

| | | |
|---|---|---|
| DE | 2014010 | * 10/1971 |
| JP | 3671729 B2 | 7/2005 |

* cited by examiner

*Primary Examiner* — Chau N Nguyen
(74) *Attorney, Agent, or Firm* — McGinn I.P. law Group, PLLC.

(57) ABSTRACT

A high frequency signal transmission cable includes a conductor, an insulator provided over a periphery of the conductor, a plating layer provided over a periphery of the insulator, and a sheath provided over a periphery of the plating layer. A crack suppressing layer is provided between the insulator and the plating layer, in such a manner as to remain in contact with the insulator while being provided with the plating layer over an outer surface of the crack suppressing layer. The crack suppressing layer suppresses the occurrence of a cracking in the plating layer by bending while moving in a longitudinal direction of the cable relative to a bending of the insulator.

15 Claims, 3 Drawing Sheets

HIGH FREQUENCY SIGNAL TRANSMISSION CABLE

CROSS-REFERENCE TO RELATED APPLICATIONS

The present invention is based on Japanese Patent Application No. 2019-123167 filed on Jul. 1, 2019, the entire contents of which are incorporated herein by reference.

BACKGROUND OF THE INVENTION

1. Field of the Invention

The present invention relates to a high frequency signal transmission cable.

2. Description of the Related Art

In recent years, for a productivity enhancing measure, the market for industrial robots (hereinafter also referred to as "robots") including cobots (also called as "co-robots" or "collaborative robots") or small articulated robots is expanding. As robot cables to be used in such a robot, a movable part cable designed to be wired in a movable part of the robot and a fixed part cable designed to connect the robot and a control device are used.

Note that Japanese Patent No. 3671729 has been disclosed as prior art document information relevant to the invention of the present application.

[Patent Document 1] Japanese Patent No. 3671729

SUMMARY OF THE INVENTION

The fixed part cable may be designed to carry out a transmission over a long distance of on the order of e.g. 25 m to 100 m. In recent years, the fixed part cable is required to carry out an ultrahigh speed long-distance transmission of a high frequency signal (e.g., in a 10 MHz to 6 GHz band) such as a video signal or the like recorded by a camera installed in the movable part of the robot to a faraway place, and thereby allow a user at the faraway place to check operating conditions for the robot in real time. For that reason, in the fixed part cable to connect the robot and the control device, the application of a high frequency signal transmission cable (e.g., a coaxial cable) having such transmission properties as to be able to carry out a long-distance transmission of the above-described high frequency signal (especially, in a band of several GHz such as 1.25 GHz to 6 GHz or the like) is being considered.

As such a high frequency signal transmission cable designed to carry out a long-distance transmission, it is conceivable to apply a coaxial cable using, as its outer conductor, a tape member such as a copper tape or the like provided with a copper foil over a resin layer. However, in such a high frequency signal transmission cable, when the tape member such as a copper tape or the like is helically wrapped around an entire periphery of an insulator, such a phenomenon called "suck out" as to cause a sharp attenuation in a predetermined frequency band (e.g., several GHz band) occurs. For that reason, it is difficult for the high frequency signal transmission cable having such a structure to carry out a long-distance transmission of the high frequency signal in the above-described several GHz band.

In addition, when a coaxial cable with a tape member being cylindrically wrapped around while adhering tightly to an entire periphery of an insulator as shown in Japanese Patent No. 3671729 is used as the high frequency signal transmission cable to be used in the fixed part cable designed to carry out a long-distance transmission, there arises a restriction on routing shape or place during long-distance cabling from the robot to the control device. For example, when such a coaxial cable is bent and routed, there is a possibility of the high frequency signal transmission properties deteriorating due to the insulator adhering tightly to and being compressed by its inner conductor or the tape member that is difficult to bend. In addition, a breaking, a wrinkling and a cracking in the tape member may occur by bending, which may lead to a deterioration in the high frequency signal transmission properties. For that reason, the high frequency signal transmission cable that satisfies both the good high frequency signal transmission properties (attenuation properties) and the pliability (flexibility) in the long-distance transmission is desired.

Accordingly, it is an object of the present invention to provide a high frequency signal transmission cable that is resistant to the occurrence of a high frequency signal attenuation during long-distance transmission, and resistant to the occurrence of a deterioration in high frequency signal transmission properties even when bent and routed during long-distance cabling.

For the purpose of solving the above problems, the present invention provides a high frequency signal transmission cable, comprising:

- a conductor;
- an insulator provided over a periphery of the conductor;
- a plating layer provided over a periphery of the insulator; and
- a sheath provided over a periphery of the plating layer,
- wherein a crack suppressing layer is provided between the insulator and the plating layer, in such a manner as to remain in contact with the insulator while being provided with the plating layer over an outer surface of the crack suppressing layer,
- wherein the crack suppressing layer suppresses the occurrence of a cracking in the plating layer by bending while moving in a longitudinal direction of the cable relative to a bending of the insulator.

The present invention also provides a high frequency signal transmission cable, comprising:

- a conductor;
- an insulator provided over a periphery of the conductor;
- a plating layer provided over a periphery of the insulator; and
- a sheath provided over a periphery of the plating layer,
- wherein a crack suppressing layer is provided between the insulator and the plating layer, in such a manner as to remain in contact with the insulator while being provided with the plating layer over an outer surface of the crack suppressing layer,
- wherein an attenuation in a band of not lower than 1.25 GHz and not higher than 6 GHz is not lower than 0.26 dB/m and not higher than 0.80 dB/m.

Points of the Invention

According to the present invention, it is possible to provide the high frequency signal transmission cable that is resistant to the occurrence of a high frequency signal attenuation during long-distance transmission, and resistant to the occurrence of a deterioration in high frequency signal transmission properties even when bent and routed during long-distance cabling.

DETAILED DESCRIPTION OF THE PREFERRED EMBODIMENTS

Embodiment

An embodiment of the present invention will be described below with reference to the accompanying drawings.

Figure 1:
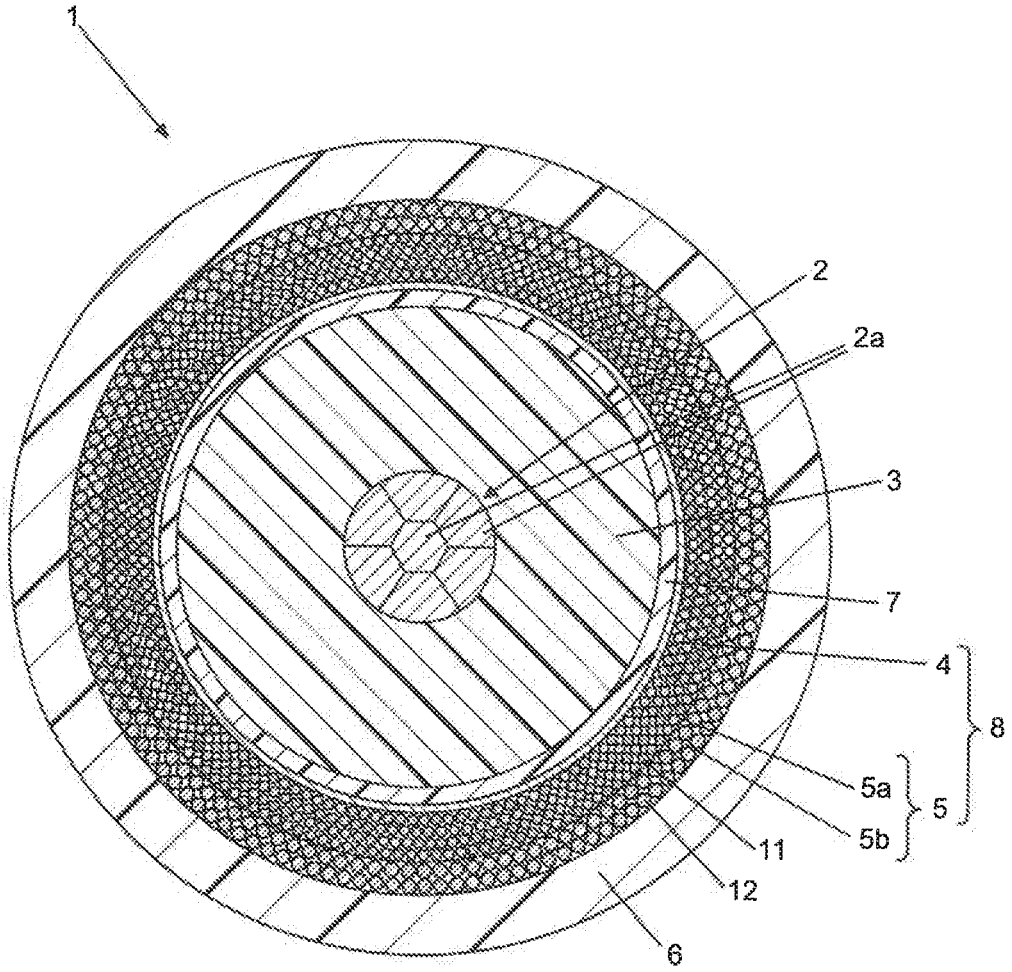
FIG. 1 is a cross-sectional view showing a cross section perpendicular to a longitudinal direction of a high frequency signal transmission cable according to one embodiment of the present invention.

FIG. 1 is a cross-sectional view showing a cross section perpendicular to a longitudinal direction of a high frequency signal transmission cable according to the present embodiment. As shown in FIG. 1, a high frequency signal transmission cable 1 is configured to include an inner conductor 2 as a conductor arranged in a center of the cable 1, an insulator 3 that is provided over a periphery of the inner conductor 2, and a plating layer 4 that is provided over a periphery of the insulator 3, a metal shield layer 5 that is provided over a periphery of the plating layer 4, and a sheath 6 that is provided over a periphery of the metal shield layer 5. That is, the high frequency signal transmission cable 1 according to the present embodiment is being configured as a coaxial cable including the inner conductor 2, the insulator 3, an outer conductor 8 (the plating layer 4 and the metal shield layer 5), and the sheath 6. Note that a structure with no metal shield layer 5 being arranged between the plating layer 4 and the sheath 6 may be employed. It should be noted, however, that it is more desirable that the metal shield layer 5 is being arranged between the plating layer 4 and the sheath 6 in order to enhance the transmission properties. The high frequency signal transmission cable 1 is designed to be used, for example, as a fixed part cable to connect a robot and a control device in a factory or the like, and has a length of, e.g., on the order of 25 m to 100 m. Note that the term "provided over" includes a case where the layers are arranged with the other layer therebetween. For example, it includes a case where the other layer may be arranged between the inner conductor 2 and the insulator 3, between the insulator 3 and the outer conductor 8, or between the outer conductor 8 and the sheath 6.

(Inner Conductor 2)

In the high frequency signal transmission cable 1 according to the present embodiment, the inner conductor 2 is made of a compressed stranded wire conductor composed of a plurality of wires 2*a* stranded together, and subjected to a compression in such a manner that a cross-sectional shape perpendicular to the longitudinal direction of the cable 1 becomes a predetermined shape. In the present embodiment, the inner conductor 2 having a circular cross section as shown in FIG. 1 is formed by compressing the stranded wire conductor formed by concentrically stranding seven wires 2*a* together through a die having a circular outlet having a smaller diameter than that of the stranded wire conductor. One of the seven wires 2*a* to be arranged at the center of the cable 1 has a substantially hexagonal shape in a sectional view, and each of the other six wires 2*a* to be arranged on the periphery thereof has a substantially fan shape in the sectional view. Further, adjacent wires 2*a* of the plurality of wires 2*a* may be in contact (surface contact) with each other in such a manner that no space forms therebetween. Furthermore, the outer surface of the compressed stranded wire conductor may be the smooth surface in the circumferential direction of the cable 1 and the longitudinal direction of the cable 1. Note that, although, in the high frequency signal transmission cable 1 according to the present embodiment shown in FIG. 1, there is shown the example where the inner conductor 2 is composed of the compressed stranded wire conductor having a circular cross-sectional shape, the inner conductor 2 may be composed of the compressed stranded wire conductor subjected to a compression into a cross-sectional shape (e.g., a polygonal shape such as a square shape or the like) other than a circular shape. Since the inner conductor 2 is composed of the compressed stranded wire conductor having a circular cross-sectional shape, the high frequency signal transmission cable 1 can easily be bent in any direction, and therefore, is easily bent and routed.

Although a normal stranded wire conductor being subjected to no compression is more flexible and easier to bend than a single wire conductor, there are many spaces between its constituent wires, and therefore its wires are in point contact. For that reason, in general, the normal stranded wire conductor has a higher conductor resistance and a lower electrical conductivity than those of a single wire conductor having the same outer diameter. By using the compressed stranded wire conductor as the inner conductor 2 as in the present embodiment, the wires 2*a* are adhered tightly to each other (are in surface contact with each other), with no space between adjacent wires 2*a* of the plurality of wires 2*a*. For that reason, the inner conductor 2 using its constituent compressed stranded wire conductor can be lowered in conductor resistance as compared to the normal stranded wire conductor having the same outer diameter. As a result, the inner conductor 2 using its constituent compressed stranded wire conductor achieves the enhanced electrical conductivity and the good attenuation properties. In addition to this, the inner conductor 2 using its constituent compressed stranded wire conductor can maintain the high bendability of the stranded wire conductor, and therefore is resistant to the occurrence of a wire break when bent, as compared to the single wire conductor. Note that, although it is preferable to use the compressed stranded wire conductor as the inner conductor 2, when the normal stranded wire conductor or the single wire conductor can achieve the same action and effect as those of the compressed stranded wire conductor described above, the normal stranded wire conductor or the single wire conductor may be employed as the inner conductor 2.

In order to achieve the good attenuation properties, the electrical conductivity of the compressed stranded wire conductor used as the inner conductor 2 is desirably 99% IACS or more. In the present embodiment, an unplated soft copper wire made of pure copper is being used as the constituent wires 2*a* of the inner conductor 2 in order to achieve the high electrical conductivity. It should be noted, however, that when the plating has an electrical conductivity of 99% IACS or higher, a soft copper wire subjected to a silver plating for example may be used as the wires 2*a*. In addition, when the wires 2*a* are compressed through the die, the wires 2*a* are subjected to the occurrence of a compressive strain, leading to a lowering in the electrical conductivity, but, by thereafter performing a heat treatment (annealing treatment), it is possible to remove the strain and achieve an electrical conductivity of 99% IACS or higher.

(Insulator 3)

As the insulator 3, it is desirable to use an insulating material having as low a permittivity as possible in order to enhance the high frequency signal transmission properties (more specifically, for example, in order to resist the occurrence of a high frequency signal attenuation in a band of 10 MHz to 6 GHz during long-distance transmission). In the present embodiment, a foamed resin that is provided over the periphery of the inner conductor 2 is being used as the insulator 3. The insulator 3 may be provided in such a manner as to be contiguous to the entire periphery of the outer surface of the inner conductor 2.

As the insulator 3, for example, an irradiated cross-linked foamed polyethylene can be used. The degree of foaming in the insulator 3 may be 40 to 70. When the foaming degree of the insulator 3 is 40 or more, its permittivity can be made small, and therefore the high frequency signal transmission properties become good. Further, when the foaming degree of the insulator 3 is 70 or less, the insulator 3 can be prevented from becoming too soft, and therefore becomes resistant to the occurrence of a collapse due to an external force caused in the high frequency signal transmission cable 1 when bent, and the high frequency signal transmission properties become good.

Note that the insulator 3 may be used that includes a foamed layer made of a foamed resin and a non-foamed layer made of a non-foamed resin that is provided over a periphery of the foamed layer. By including the non-foamed layer, when bending the high frequency signal transmission cable 1 or the like, it is possible to prevent the foamed layer from collapsing and it is possible to further suppress the occurrence of a deterioration in the high frequency signal transmission properties.

(Metal Shield Layer 5)

A crack suppressing layer 7 and the plating layer 4 are in turn provided over the periphery of the insulator 3, and the metal shield layer 5 is provided over the periphery of the plating layer 4. The crack suppressing layer 7 and the plating layer 4 will be described later. In the high frequency signal transmission cable 1, the plating layer 4 and the metal shield layer 5 serve as the outer conductor 8.

The metal shield layer 5 together with the plating layer 4 (described later) constitutes the outer conductor 8, and the metal shield layer 5 is constituted by braiding or side by side wrapping with metal wires. In the present embodiment, the metal shield layer 5 is being configured as a braided shield composed of braided metal wires. As a material for the metal wires, there is a soft copper wire or a hard copper wire made of e.g. copper or a copper alloy. Further, the metal wires may be made of aluminum or an aluminum alloy. The metal wires may be subjected to a plating on its outer surface.

Further, in the present embodiment, the metal shield layer 5 is configured to include a first braided shield 5*a*, which is provided over a periphery of the plating layer 4 in such a manner as to be in contact with an outer surface of the plating layer 4, and a second braided shield 5*b*, which is provided over a periphery of the first braided shield 5*a* in such a manner as to be in contact with an outer surface of the first braided shield 5*a*. The formations of the first braided shield 5*a* and the second braided shield 5*b* may be performed continuously on the same production line or on separate production lines.

The second braided shield 5*b* to be provided in the outer side of the metal shield layer 5 is mainly for intercepting an external noise. The high frequency signal transmission cable 1 is designed to be used in a factory or the like, for example, and is affected by a large energy noise such as a low frequency noise or the like due to on/off switching of a motor to drive the robot, the control device, or the like. For that reason, in the second braided shield 5*b*, it is desirable to use the metal wires 12 having a larger outer diameter than that of the metal wires 11 used in the first braided shield 5*a*, to thereby lower the conductor resistance of the second braided shield 5*b*.

On the other hand, the first braided shield 5*a* to be provided in the inner side of the metal shield layer 5 is mainly for suppressing internal signal radiation to the external side. Since the high frequency signal transmission cable 1 carries out a high frequency signal transmission of e.g. 10 MHz to 6 GHz, if the mesh size of the braided shield (the space between the wires) is large, the signal radiation to the external side tends to occur. Further, if the outer diameters of the metal wires to be used in the first braided shield 5*a* are larger than the metal wires to be used in the second braided shield 5*b*, the high frequency signal transmission cable 1 may be difficult to bend. For that reason, in the first braided shield 5*a*, it is desirable to use its constituent metal wires 11 with a small outer diameter, and make its mesh size small. In other words, the outer diameters of the metal wires 12 to be used in the second braided shield 5*b* may be larger than the outer diameters of the metal wires 11 to be used in the first braided shield 5*a*.

More specifically, the outer diameters of the metal wires to be used in the first braided shield 5*a* may be 0.08 mm or more and 0.14 mm or less in order to achieve the high bendability and the micro fine mesh size. Further, the outer diameters of the metal wires 12 to be used in the second braided shield 5*b* may be 0.10 mm or more and 0.16 mm or less in order to achieve the high bendability and the low conductor resistance. Further, in order to allow the first braided shield 5*a* and the second braided shield 5*b* to have their respective distinct functions, the outer diameters of the metal wires 11 to be used in the first braided shield 5*a* may be not larger than 90% of the outer diameters of the metal wires 12 to be used in the second braided shield 5*b*.

More specifically, the outer diameters of the metal wires to be used in the first braided shield 5*a* may be 0.08 mm or more and 0.14 mm or less in order to achieve the high bendability and the micro fine mesh size. Further, the outer diameters of the metal wires to be used in the second braided shield 5*b* may be 0.10 mm or more and 0.16 mm or less in order to achieve the high bendability and the low conductor resistance. Further, in order to allow the first braided shield 5*a* and the second braided shield 5*b* to have their respective distinct functions, the outer diameters of the metal wires to be used in the first braided shield 5*a* may be not larger than 90% of the outer diameters of the metal wires to be used in the second braided shield 5*b*.

(Sheath 6)

The sheath 6 is made of an insulative resin composition such as a PVC (polyvinyl chloride), a urethane, a polyolefin or the like. Although the sheath 6 is formed by extrusion molding, if solid molding is performed, the resin constituting the sheath 6 enters the spaces between the wires of the metal shield layer 5, and the high frequency signal transmission cable 1 may become hard and difficult to bend. For the purpose of avoiding this, in the present embodiment, the sheath 6 is being molded by tube extrusion. This allows the resin constituting the sheath 6 to be suppressed from entering the spaces between the wires of the metal shield layer 5, and the sheath 6 and the metal shield layer 5 to be moved separately from each other. That is, in the present embodiment, the sheath 6 and the metal shield layer 5 are not adhered, so that the metal shield layer 5 can relatively freely be moved within the sheath 6. This makes the high frequency signal transmission cable 1 easier to bend.

(Plating Layer 4 and Crack Suppressing Layer 7)

Over the periphery of the insulator 3, the crack suppressing layer 7 is provided in such a manner as to be in contact with the outer surface of the insulator 3 with no space forming between the crack suppressing layer 7 and the outer surface of the insulator 3, and in such a manner that, when the high frequency signal transmission cable 1 is bent, the crack suppressing layer 7 can be bent while being moved in the longitudinal direction of the cable 1 relative to the bending of the insulator 3 with the crack suppressing layer 7 remaining in contact with the outer surface of the insulator 3 with no space therebetween (with the crack suppressing layer 7 remaining in contact with the insulator 3 with no space therebetween), and the plating layer 4 is provided on the outer surface of the suppressing layer 7. Note that it is possible to observe, by using an optical microscope or an electron microscope, that the crack suppressing layer 7 is in contact with the outer surface of the insulator 3 with no space therebetween.

The crack suppressing layer 7 serves as a foundation layer for the plating layer 4, and when the high frequency signal transmission cable 1 is bent, the crack suppressing layer 7 acts to suppress the occurrence of a cracking in the plating layer 4 resulting from the bending of the insulator 3 following the bending of the high frequency signal transmission cable 1. In other words, the crack suppressing layer 7 is a layer to suppress the occurrence of a cracking in the plating layer 4 by bending while moving in the longitudinal direction of the cable 1 relative to the bending of the insulator 3. Note that the "cracking" referred to herein refers to a cracking in the plating layer 4 that occurs in a range from the outer surface of the plating layer 4 to the inner surface of the plating layer 4 (the surface in contact with the insulator 3). Further, the "suppress the occurrence of a cracking in the plating layer 4" referred to herein refers to making the plating layer 4 resistant to the occurrence of a cracking, as compared to when the crack suppressing layer 7 of the present embodiment is not provided.

The crack suppressing layer 7 is provided between the insulator 3 and the plating layer 4, and it is provided in such a manner as to remain in contact with the outer surface of the insulator 3 with no space therebetween, but when the high frequency signal transmission cable 1 is bent, be able to be moved in the longitudinal direction of the cable 1 relative to the insulator 3 (be able to be slid in the longitudinal direction of the cable 1 relative to the insulator 3) while being maintained in contact with the insulator 3 with no space between the crack suppressing layer 7 and the insulator 3. The crack suppressing layer 7 is not being joined to the insulator 3, but is provided in such a manner as to be able to be moved separately from the insulator 3. Further, the crack suppressing layer 7 is cylindrically being provided over the insulator 3.

The crack suppressing layer 7 is formed, e.g., by tube extruding the resin over the periphery of the insulator 3. If the outer surface of the insulator 3 is melted by heat during the formation of the crack suppressing layer 7, the insulator 3 and the crack suppressing layer 7 are joined together at the interface with the insulator 3 and the crack suppressing layer 7 being in contact with each other. For the purpose of avoiding this, as the resin to be used in the crack suppressing layer 7, the resin having a lower melting point than that of the resin to be used in the insulator 3 may be used. The crack suppressing layer 7 is formed by tube extruding the resin having a lower melting point than that of the resin to be used in the insulator 3 at a temperature at which the outer surface of the insulator 3 is not melted. Note that the crack suppressing layer 7 may be composed of a plurality of layers.

In the present embodiment, a non-cross-linked polyethylene is being used as the crack suppressing layer 7. The melting point of the polyethylene is increased by irradiation cross-linking by on the order of 20° C. For that reason, for example, by using an irradiated cross-linked polyethylene as the resin constituting the insulator 3 and using a non-cross-linked polyethylene as the resin constituting the crack suppressing layer 7, it is possible to easily form the crack suppressing layer 7 that can, with the crack suppressing layer 7 remaining in contact with the outer surface of the insulator 3 with no space therebetween, be bent while being moved in the longitudinal direction of the cable 1 relative to the bending of the insulator 3. Note that the resin to be used in the insulator 3 or the crack suppressing layer 7 is not limited to the above described resin.

The thickness of the crack suppressing layer 7 is made thinner than the thickness of the insulator 3. More specifically, the thickness of the crack suppressing layer 7 may be 0.10 mm or more and 0.20 mm or less. When the thickness of the crack suppressing layer 7 is 0.10 mm or more, the mechanical strength of the crack suppressing layer 7 is increased, and therefore it is easy to suppress the occurrence of a fracture in the crack suppressing layer 7 due to bending. Further, when the thickness of the crack suppressing layer 7 is 0.20 mm or less, the stress applied to the plating layer 4 in the bending or the like of the high frequency signal transmission cable 1 (the stress applied to the plating layer 4 resulting from bending of the crack suppressing layer 7 following the bending of the high frequency signal transmission cable 1) is small, and therefore the plating layer 4 is easily suppressed from cracking.

Prior to the formation of the plating layer 4, the outer surface of the crack suppressing layer 7 may be subjected to a predetermined treatment. Specifically, the outer surface of the crack suppressing layer 7 is subjected to a blasting treatment whereby a powder made of dry ice, metal particles, carbon particles, oxide particles, carbide particles, nitride particles, or the like is blasted to the outer surface of the crack suppressing layer 7, to roughen the outer surface of the crack suppressing layer 7 to a predetermined roughness, and the roughened outer surface of the crack suppressing layer 7 is further subjected to a modification treatment such as a corona discharge exposure treatment or the like. Thereafter, the plating layer 4 is formed by applying an electroless plating in such a manner as to coat the entire periphery of the crack suppressing layer 7. As a result, when the plating layer 4 is formed on the outer surface of the crack suppressing layer 7, the plating layer 4 is adhered tightly over the entire periphery of the outer surface of the crack suppressing layer 7, and when the high frequency signal transmission cable 1 is bent, the crack suppressing layer 7 and the plating layer 4 are bent while being integral and moved relative to the bending of the insulating layer 3. This makes it possible to enhance the effect of suppressing the occurrence of a cracking in the plating layer 4. Note that, after applying an electroless plating, an electrolytic plating may further be applied to form the plating layer 4.

The plating layer 4 together with the metal shield layer 5 constitutes the outer conductor 8. As described above, although the metal shield layer 5 is configured by braiding or side by side wrapping with the metal wires, the use of only the metal shield layer 5 may lead to internal signal radiation from the spaces between the metal wires to the external side, and therefore an increase in the amount of attenuation. By providing the plating layer 4, the spaces between the metal wires of the metal shield layer 5 are impregnated therewith, and the amount of attenuation is therefore further reduced. Note that the plating layer 4 and the metal shield layer 5 are in contact with each other and are electrically connected together.

As the plating layer 4, the plating made of a metal having an electrical conductivity of 99% or more (99% IACS or more) may be used, and e.g., a metal made of copper or silver can be used.

The thickness of the plating layer 4 may be 2 μm or more and 5 μm or less. When the thickness of the plating layer 4 is 2 μm or more, even with the metal shield layer 5 and the plating layer 4 being in contact with each other and being subjected to a bending, the plating layer 4 is resistant to the occurrence of a cracking. Further, when the thickness of the plating layer 4 is 5 μm or less, it is possible to prevent the high frequency signal transmission cable 1 from becoming difficult to bend due to the plating layer 4 becoming hard.

Figure 2:
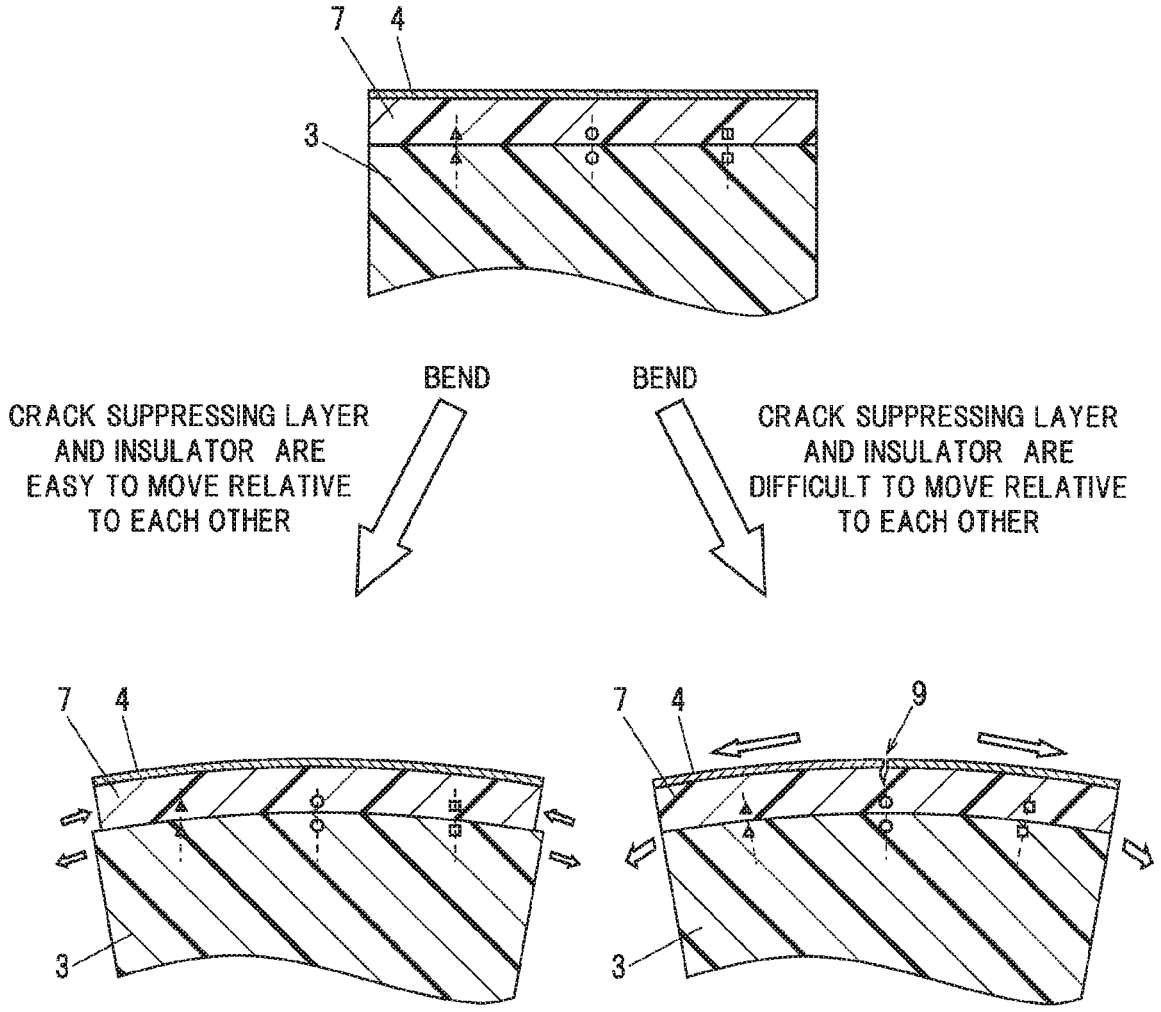
FIG. 2 is a diagram for explaining an effect of a movement of a crack suppressing layer relative to an insulator.

As shown in FIG. 2, the crack suppressing layer 7 can be bent while being moved relative to the bending of the insulator 3. For that reason, in the high frequency signal transmission cable 1, the occurrence of a cracking in the plating layer 4 can be suppressed. As a result, when the high frequency signal transmission cable 1 is bent, the insulator 3 is bent while being stretched in the longitudinal direction of the cable 1, but the crack suppressing layer 7 can be bent without following the stretching of the insulator 3 in the longitudinal direction of the cable 1, and therefore, the plating layer 4 can be suppressed from stretching in the longitudinal direction of the cable 1. On the other hand, when the crack suppressing layer 7 is difficult to bend while moving relative to the bending of the insulator 3, when the high frequency signal transmission cable 1 is bent, the plating layer 4 is stretched along the outer surface of the insulator 3 in such a manner as to follow the stretching of the insulator 3 in the longitudinal direction of the cable 1, and therefore the plating layer 4 is acted on by a large load and easily subjected to the occurrence of a cracking 9.

Figure 3:
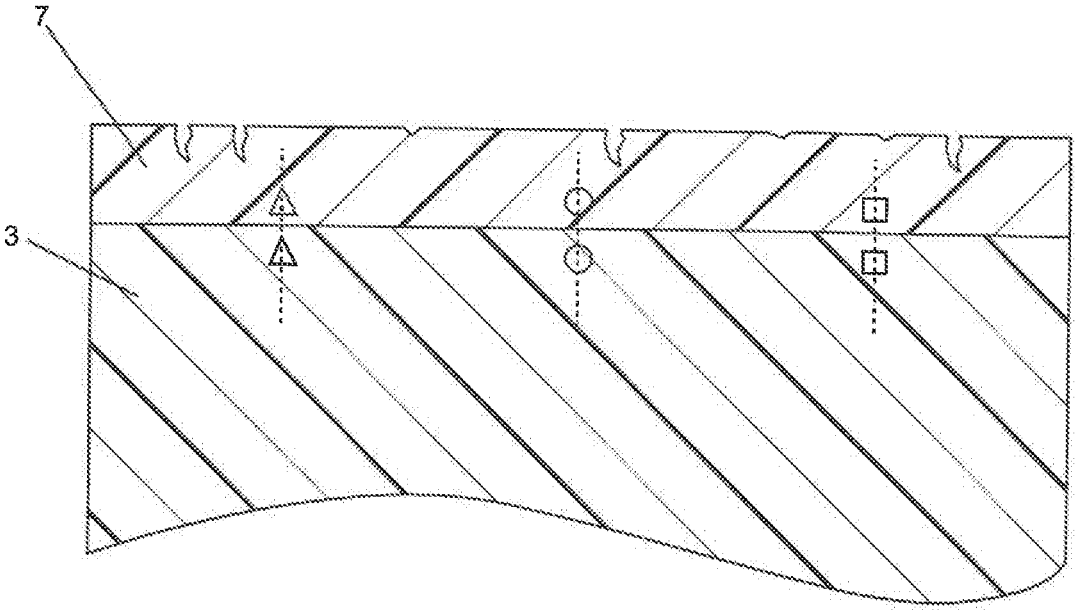
FIG. 3 is a side view of the crack suppressing layer disposed on the insulator.

When the cracking 9 occurs in the plating layer 4, a phenomenon called "co-cracking", that is the occurrence of the cracking 9 in the foundation layers (the crack suppressing layer 7 or the insulator 3) for the plating layer 4 as well as in the plating layer 4, may occur. For that reason, when the plating layer 4 is formed directly on the outer surface of the insulator 3, if the cracking 9 occurs in the plating layer 4 by bending or the like, the en-cracking of the plating layer 4 and the insulator 3 may occur, leading to a failure such as an insulating failure or the like. In the present embodiment, the plating layer 4 is being formed with the crack suppressing layer 7 between it and the insulator 3 which is the member different from the insulator 3, and the crack suppressing layer 7 is bent while being moved relative to the bending of the insulator 3, and therefore the plating layer 4 is resistant to the occurrence of the cracking 9. Further, even when the plating layer 4 is subjected to the cracking 9, no co-cracking can occur in the insulator 3, and a failure such as an insulating failure or the like can be suppressed. As shown in FIG. 3, prior to the formation of the platin layer 4, the outer surface of the crack suppressing layer 7 may be subjected to a predetermined treatment to roughen the outer surface of the crack suppressing layer 7 to a predetermined roughness.

Furthermore, since the plating layer 4 is being formed on the crack suppressing layer 7 made of the resin, even when the high frequency signal transmission cable 1 is appropriately bent according to a routing layout, the crack suppressing layer 7 can be slid relative to the insulator 3 while being maintained in contact with the outer surface of the insulator 3 with no space therebetween, and therefore the distance between the inner conductor 2 and the plating layer 4 can be held substantially constant. For example, when a metal tape formed with a metal layer on one surface of a resin layer is cylindrically wrapped in place of the plating layer 4 and the crack suppressing layer 7, a wrinkling or a breaking may occur in the metal tape by bending, causing a gap formation between the insulator and the metal tape, or the like, and a local variation in the characteristic impedance, leading to an increase in the return loss due to the mismatching of the characteristic impedance. On the other hand, in the high frequency signal transmission cable 1 according to the present embodiment, since the crack suppressing layer 7 is flexibly deformed according to bending, the distance between the inner conductor 2 and the plating layer 4 is kept substantially constant, so the characteristic impedance can be kept substantially constant in the longitudinal direction of the high frequency signal transmission cable 1, and the return loss can be suppressed and the good attenuation properties can be achieved.

Table 1 shows measurement results on attenuation per unit length in transmission of 0.625 GHz, 1.25 GHz, and 6 GHz signals, in each of the high frequency signal transmission cable 1 (Example) according to the present embodiment, and a comparative example using a normal stranded wire conductor in place of the inner conductor 2 made of the compressed stranded wire conductor of the Example, and a metal tape helically wrapped in place of the plating layer 4 and the crack suppressing layer 7 of the Example.

In the Example, the insulator 3 made of an irradiated cross-linked foamed polyethylene was provided on the periphery of the inner conductor (outer diameter: 1.00 mm) 2 made of the compressed stranded wire conductor having a circular transverse cross section composed of seven wires stranded together, and then by tube extruding a resin made of a polyethylene at a temperature at which the outer surface of the insulator 3 is not melted, the periphery of the insulator 3 was provided with the crack suppressing layer (thickness: 0.10 mm) 7 that can, with the crack suppressing layer 7 remaining in contact with the outer surface of the insulator 3, be bent while being moved in the longitudinal direction of the cable 1 relative to the bending of the insulator 3. And the outer surface of the crack suppressing layer 7 was subjected to the above described predetermined treatment, and thereafter was provided with the plating layer (thickness: 2 μm) 4 made of copper by electroless plating in such a manner as to coat the entire periphery of the crack suppressing layer 7. The first braided shield **5*a* was provided by braiding with tin-plated soft copper wires (outer diameter: 0.10 mm) at a braid density of 90% or more in such a manner as to be in contact with the outer surface of the plating layer 4, and further the second braided shield 5*b* was provided by braiding with tin-plated soft copper wires (outer diameter: 0.12 mm) at a braid density of 90% or more in such a manner as to be in contact with the outer surface of the first braided shield 5*a*, thereby resulting in the metal shield layer 5. The periphery of the metal shield layer 5 was provided with the sheath (thickness: 0.90 mm) 6 with a resin composition made of a PVC, thereby resulting in the high frequency signal transmission cable 1** of the example.

Note that, in both the example and the comparative example, the characteristic impedance was set at 75 g. In addition, the outer diameter of the high frequency signal transmission cable 1 of the example was 7.65 mm, and the outer diameter of the high frequency signal transmission cable of the comparative example was 7.68 mm. In addition, in the high frequency signal transmission cable 1 of the example, the compressed stranded wire conductor was used in the inner conductor 2, while in the high frequency signal transmission cable of the comparative example, the normal stranded wire conductor was used in the inner conductor 2. With these high frequency signal transmission cables being bent with inner diameters of about 12 times the outer diameters of the cables, the attenuation was measured using a network analyzer. Further, the characteristic impedance was measured using a TDR measuring instrument.

TABLE 1

| | | Example | Comparative example |
|---|---|---|---|
| Characteristic impedance (Ω) | | 75 | 75 |
| Attenuation | 0.625 GHz | 0.14 | 0.49 |
| (dB/m) | 1.25 GHz | 0.26 | 1.41 |
| | 6 GHz | 0.80 | 1.58 |
| Outer diameter (mm) | | 7.65 | 7.68 |

As shown in Table 1, the high frequency signal transmission cable 1 of the example was small in attenuation at any frequency, as compared to the high frequency signal transmission cable of the comparative example, so it was able to be confirmed that good attenuation properties were achieved. This is considered to be because the crack suppressing layer 7 provided between the insulator 3 and the plating layer 4 was bent while being moved in the longitudinal direction of the cable 1 relative to the bending of the insulator 3, thereby being able to suppress the occurrence of a cracking in the plating layer 4, and keep the distance between the inner conductor 2 and the plating layer 4 substantially constant, therefore resulting in being able to homogenize the characteristic impedance. Furthermore, it is considered that the electrical conductivity resulting from using the compressed stranded wire conductor as the inner conductor 2 contributed to the good attenuation properties. In particular, in the high band of not lower than 1.25 GHz and not higher than 6 GHz, the high frequency signal transmission cable 1 of the example was very small in attenuation as compared to the comparative example, so it was able to be confirmed that the high frequency signal transmission cable 1 of the example was excellent in the high frequency signal transmission properties (attenuation properties) with the high frequency signal transmission cable 1 being bent.

Incidentally, for example, a connector is attached to an end portion of the high frequency signal transmission cable 1. At this point, the end portion of the high frequency signal transmission cable 1 is subjected to a termination to expose the plating layer 4, the insulator 3, and the inner conductor 2 in a staircase pattern. In the present embodiment, since the crack suppressing layer 7 and the insulator 3 are not being adhered or joined to each other, the plating layer 4 and the crack suppressing layer 7 can easily be peeled off from the outer surface of the insulator 3, and the termination can easily be performed.

Also, the plating layer 4 and the inner conductor 2 exposed by the termination are each connected to a substrate within the connector by soldering or the like. When the plating layer 4 is connected thereto by soldering or the like, the plating layer 4 is heated. At this point, for example, when the plating layer 4 is being formed directly on the outer surface of the insulator 3, the insulator 3 is expanded due to heat, and the plating layer 4 is stretched by following the expansion of the insulator 3, which may therefore cause the plating layer 4 to crack. In the present embodiment, even when the insulator 3 is expanded due to heating the plating layer 4, the crack suppressing layer 7 acts to be slid between the plating layer 4 and the insulator 3 without following this expansion of the insulator 3, so there is also merit that the plating layer 4 is resistant to the occurrence of a cracking resulting from thermal expansion of the insulator 3.

Actions and Advantageous Effects of the Embodiment

As described above, the high frequency signal transmission cable 1 according to the present embodiment is configured to include the crack suppressing layer 7, between the insulator 3 and the plating layer 4, that can, with the crack suppressing layer 7 being provided in contact with the insulator 3, be bent while being moved in the longitudinal direction of the cable 1 relative to the bending of the insulator 3.

As a result, even when the high frequency signal transmission cable 1 is bent and routed, when the insulator 3 is stretched in the longitudinal direction of the cable 1 according to the bending of the insulator 3, the crack suppressing layer 7 is deformed (bent) in such a manner as to be slid between the plating layer 4 and the insulator 3 without following the stretching of the insulator 3, so the occurrence of a cracking in the plating layer 4 can be suppressed, and the distance between the inner conductor 2 and the plating layer 4 can be kept constant. As a result, it is possible to achieve the high frequency signal transmission cable 1 having the good transmission properties (attenuation properties) that is resistant to the occurrence of a high frequency (e.g., a band of 10 MHz to 6 GHz) signal attenuation even during long-distance transmission.

Further, since the crack suppressing layer 7 can be moved in the longitudinal direction of the cable 1 relative to the insulator 3, the high frequency signal transmission cable 1 is easy to bend, and it is therefore possible to achieve the high frequency signal transmission cable 1 that is resistant to the occurrence of a deterioration in the high frequency signal transmission properties even when bent and routed during long-distance cabling.

Summary of the Embodiment

Next, the technical ideas grasped from the above-described embodiments will be described with the aid of the reference characters and the like in the embodiments. It should be noted, however, that each of the reference characters and the like in the following descriptions is not to be construed as limiting the constituent elements in the claims to the members and the like specifically shown in the embodiments.

[1] A high frequency signal transmission cable (1), comprising: a conductor (2); an insulator (3) provided over a periphery of the conductor (2); a plating layer (4) provided over a periphery of the insulator (3); and a sheath (6) provided over a periphery of the plating layer (4), wherein a crack suppressing layer (7) is provided between the insulator (3) and the plating layer (4), in such a manner as to remain in contact with the insulator (3) while being provided with the plating layer (4) over an outer surface of the crack suppressing layer (7), wherein the crack suppressing layer (7) suppresses the occurrence of a cracking in the plating layer (4) by bending while moving in a longitudinal direction of the cable (1) relative to a bending of the insulator (3).

[2] The high frequency signal transmission cable (1) according to [1], wherein a thickness of the crack suppressing layer (7) is thinner than a thickness of the insulator (3).

[3] The high frequency signal transmission cable (1) according to [1] or [2], wherein the crack suppressing layer (7) has a thickness of 0.10 mm or more and 0.20 mm or less.

[4] The high frequency signal transmission cable (1) according to any one of [1] to [3], wherein the plating layer (4) comprises a metal having an electrical conductivity of 99% or more.

[5] The high frequency signal transmission cable (1) according to any one of [1] to [4], wherein the plating layer (4) has a thickness of 2 μm or more and 5 μm or less.

[6] The high frequency signal transmission cable (1) according to any one of [1] to [5], wherein the conductor (2) comprises a compressed stranded wire conductor (2*a*) comprising a plurality of wires stranded together and compressed to have a predetermined cross-sectional shape perpendicular to the longitudinal direction of the cable (1).

[7] The high frequency signal transmission cable (1) according to any one of [1] to [6], wherein a melting point of a resin to be used in the crack suppressing layer (7) is lower than a melting point of a resin to be used in the insulator (3).

[8] The high frequency signal transmission cable (1) according to any one of [1] to [7], wherein the insulator (3) comprises an irradiated cross-linked polyethylene, while the crack suppressing layer (7) comprises a non-cross-linked polyethylene.

[9] The high frequency signal transmission cable (1) according to any one of [1] to [8], further comprising:

a metal shield layer (5) provided over a periphery of the plating layer (4).

[10] A high frequency signal transmission cable (1), comprising: a conductor (2); an insulator (3) provided over a periphery of the conductor (2); a plating layer (4) provided over a periphery of the insulator (3); and a sheath (6) provided over a periphery of the plating layer (4), wherein a crack suppressing layer (7) is provided between the insulator (3) and the plating layer (4), in such a manner as to remain in contact with the insulator (3) while being provided with the plating layer (4) over an outer surface of the crack suppressing layer (7), wherein an attenuation in a band of not lower than 1.25 GHz and not higher than 6 GHz is not lower than 0.26 dB/m and not higher than 0.80 dB/m.

Although the embodiments of the present invention have been described above, the above described embodiments are not to be construed as limiting the inventions according to the claims. Further, it should be noted that not all the combinations of the features described in the embodiments are indispensable to the means for solving the problem of the invention.

Further, the present invention can appropriately be modified and implemented without departing from the spirit thereof. For example, although, in the above embodiment, the foamed resin is being used as the insulator 3, the insulator 3 is not limited to this, but a non-foamed resin may be used as the insulator 3.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A high frequency signal transmission cable, comprising:

a conductor;

an insulator provided over a periphery of the conductor;

a plating layer provided over a periphery of the insulator;

a sheath provided over a periphery of the plating layer, wherein a crack suppressing layer is provided between the insulator and the plating layer, in such a manner as to remain in contact with the insulator while being provided with the plating layer over an outer surface of the crack suppressing layer, wherein an attenuation in a band of not lower than 1.25 GHz and not higher than 6 GHz is not lower than 0.26 dB/m and not higher than 0.80 dB/m, wherein the crack suppressing layer, is unadhered to the insulator, wherein the plating layer is adhered to the crack suppressing layer, and wherein the crack suppressing layer suppresses an occurrence of a cracking in the plating layer by bending together with the plating layer while being integral and moving with the plating layer in a longitudinal direction of the cable relative to a bending of the insulator;

a first braided shield disposed on an outer surface of the plating layer; and a second braided shield disposed on an outer surface of the first braided shield and on an inner surface of the sheath, wherein the second braided shield comprises metal wires having a larger outer diameter than metal wires of the first braided shield.

2. The high frequency signal transmission cable according to claim 1, wherein the outer surface of the crack suppressing layer is roughened, the roughened outer surface of the crack suppressing layer is subjected to a corona discharge exposure treatment, and an electroless plating is applied to form the plating layer on an entire periphery of the crack suppressing layer.

3. The high frequency signal transmission cable according to claim 1, wherein the crack suppressing layer is configured to freely move relative to the insulator.

4. The high frequency signal transmission cable according to claim 1, wherein the crack suppressing layer and the plating layer are configured to freely move relative to the insulator.

5. A high frequency signal transmission cable, comprising:

a conductor;

an insulator provided over a periphery of the conductor;

a plating layer provided over a periphery of the insulator;

a sheath provided over a periphery of the plating layer, wherein a crack suppressing layer is provided between the insulator and the plating layer, in such a manner as to remain in contact with the insulator while being provided with the plating layer over an outer surface of the crack suppressing layer, wherein the crack suppressing layer is unadhered to the insulator, wherein the plating layer is adhered to the crack suppressing layer, and wherein the crack suppressing layer suppresses an occurrence of a cracking in the plating layer by bending together with the plating layer while being integral and moving with the plating layer in a longitudinal direction of the cable relative to a bending of the insulator;

a first braided shield disposed on an outer surface of the plating layer; and a second braided shield disposed on an outer surface of the first braided shield and on an inner surface of the sheath, wherein the second braided shield comprises metal wires having a larger outer diameter than metal wires of the first braided shield.

6. The high frequency signal transmission cable according to claim 5, wherein a thickness of the crack suppressing layer is less than a thickness of the insulator.

7. The high frequency signal transmission cable according to claim 5, wherein the crack suppressing layer has a thickness of 0.10 mm or more and 0.20 mm or less.

8. The high frequency signal transmission cable according to claim 5, wherein the plating layer comprises a metal having an electrical conductivity of 99% or more.

9. The high frequency signal transmission cable according to claim 5, wherein the plating layer has a thickness of 2 μm or more and 5 μm or less.

10. The high frequency signal transmission cable according to claim 5, wherein the conductor comprises a compressed stranded wire conductor comprising a plurality of wires stranded together and compressed to have a predetermined cross-sectional shape perpendicular to the longitudinal direction of the cable.

11. The high frequency signal transmission cable according to claim 5, wherein a melting point of a resin to be used in the crack suppressing layer is lower than a melting point of a resin to be used in the insulator.

12. The high frequency signal transmission cable according to claim 5, wherein the insulator comprises an irradiated cross-linked polyethylene, and the crack suppressing layer comprises a non-cress-linked polyethylene.

13. The high frequency signal transmission cable according to claim 5, wherein the crack suppressing layer and the plating layer are configured to freely move relative to the insulator.

14. The high frequency signal transmission cable according to claim 5, wherein the outer surface of the crack suppressing layer is roughened, the roughened outer surface of the crack suppressing layer is subjected to a corona discharge exposure treatment, and an electroless plating is applied to form the plating layer on an entire periphery of the crack suppressing layer.

15. The high frequency signal transmission cable according to claim 5, wherein the crack suppressing layer is configured to freely move relative to the insulator, and wherein the crack suppressing layer is configured to remain in contact with the insulator with no space therebetween.

* * * * *